United States Patent [19]

Satterthwaite

[11] 4,108,615

[45] Aug. 22, 1978

[54] VANED ANODE FOR HIGH-INTENSITY IONIZER STAGE OF ELECTROSTATIC PRECIPITATOR

[75] Inventor: Dale J. Satterthwaite, Bellevue, Wash.

[73] Assignee: Electric Power Research Institute, Inc., Palo Alto, Calif.

[21] Appl. No.: 785,469

[22] Filed: Apr. 7, 1977

[51] Int. Cl.[2] ..... B03C 3/00

[52] U.S. Cl. ..... 55/2; 55/117; 55/138; 55/140; 55/152; 55/154; 361/226

[58] Field of Search ..... 55/2, 5, 12, 101, 108, 55/117, 120, 122, 128, 135, 138, 140, 148, 150, 152, 151, 153, 154; 361/226

[56] References Cited

U.S. PATENT DOCUMENTS

| | | | |
|---|---|---|---|
| 1,475,995 | 12/1923 | Heis et al. | 55/150 |
| 2,424,654 | 7/1947 | Gamble | 261/DIG. 54 |
| 3,521,125 | 7/1970 | Nelson | 361/227 |
| 3,582,050 | 6/1971 | Kozak | 261/DIG. 54 |
| 3,747,299 | 7/1973 | Chiang | 55/2 |
| 3,988,130 | 10/1976 | Ramsey et al. | 55/151 |

FOREIGN PATENT DOCUMENTS

| | | | |
|---|---|---|---|
| 833,798 | 3/1952 | Fed. Rep. of Germany | 55/138 |
| 383,344 | 12/1964 | Switzerland | 55/101 |
| 164,014 | 7/1921 | United Kingdom | 55/135 |
| 923,431 | 4/1963 | United Kingdom | 55/101 |

*Primary Examiner*—Bernard Nozick

*Attorney, Agent, or Firm*—Townsend and Townsend

[57] ABSTRACT

An improved electrode assembly for a high-intensity ionizer array utilized as the first stage in a two-stage electrostatic precipitator. Each ionizer unit employs a pair of co-axial electrodes to create a high-intensity electric field across the path of a particulate-laden gas stream. As the gas passes through the field it is intensely ionized and the particulate becomes highly charged. The ionizer anode comprises a venturi diffuser through which the gas stream flows immediately prior to entry into a precipitator stage which removes the charged particles. The ionizer cathode is a disk co-axially mounted within the venturi throat and having an arcuate periphery. A high voltage power supply connected between the anode and cathode establishes a high-intensity corona discharge in the annular region formed between the periphery of the cathode disk and the surrounding cylindrical anode surface. The section of the venturi wall in the area of the cathode disk is formed with a series of axially spaced conical vanes. The spaces between adjacent vanes define annular injection nozzles which are oriented to direct clean gas supplied under pressure from an external source into the venturi charging region and along the interior anode surface in a laminar flow in the direction of the primary gas stream. The laminar film of clean gas sweeping along the venturi wall envelopes the primary gas stream and provides an effective barrier to particle deposition on the anode surface.

10 Claims, 6 Drawing Figures

VANED ANODE FOR HIGH-INTENSITY IONIZER STAGE OF ELECTROSTATIC PRECIPITATOR

ACKNOWLEDGEMENT

This invention was made under contract with or supported by the Electric Power Research Institute, Inc. of Palo Alto, Calif.

BACKGROUND OF THE INVENTION

1. Field of the Invention

The present invention relates to high-intensity ionizers which pre-charge particulate matter entrained in a contaminated gas stream prior to removal of the charged particles from the stream by electrostatic precipitation. More specifically, the invention is directed to an improved electrode configuration for a co-axial venturi ionizer wherein jets of clean gas are injected into the venturi through a series of circumferential nozzles and flow over the ionizer anode surface in a laminar film to prevent particulate deposition thereon.

2. Description of the Prior Art

Standards for emissions of particulate in flue gases issuing from coal fired electrical power station stacks are becoming increasingly more stringent. Current air quality standards require that more than 99% of the fly ash produced by burning coal be removed prior to discharge of the combustion gases from the stack. Thus, the efficiency of particulate collection must increase in proportion to the ash content of the coal. In addition, in an effort to reduce the emission of certain gaseous pollutants, particularly the sulfur oxides, it has become increasingly necessary to use low sulfur coal in electrical power generating plants.

The electrostatic precipitator is the most commonly used device for the removal of particulate matter from power station stack gases. Because the size of an electrostatic precipitator is determined by the efficiency of fly ash removal required, an increase in required fly ash collection efficiency requires a corresponding increase in equipment size and cost. Moreover, because fly ash resistivity tends to be inversely related to the level of combustible sulfur in the coal burned, the use of low sulfur coals to directly reduce gaseous sulfur oxide emissions, produces highly resistive dusts. It has been demonstrated that the size of the electrostatic precipitator necessary to achieve a given level of collection efficiency increases with increasing electrical resistivity of the fly ash. The use of low sulfur coals therefore further increases the size and cost of the precipitator.

Recently, high-intensity ionizers have been developed in which a unique electrode geometry produces a stable high-intensity corona discharge through which the particulate-laden gas is passed. The ionized flue gases produced charge the particulate matter to a much higher level than is achievable with a conventional electrostatic precipitator. When the ionizer is followed with an electrostatic precipitator, the higher particle charge results in a higher collection efficiency in the precipitator due to higher migration or particle drift velocity. In such a two-stage arrangement, the ionizer acts as the charging stage and the precipitator serves as the collecting stage.

Such high-intensity ionizers utilize a co-axial pair of electrodes to generate a high-intensity field expanding radially and axially with respect to the direction of gas flow. The anode in such an arrangement typically takes the form of a venturi diffuser through which the stack gases flow immediately prior to entering the precipitator stage. The cathode is a disk co-axially mounted within the venturi throat and is formed with a curved peripheral edge having a radius much smaller than the inner radius of the venturi. When a high voltage power supply is connected between the anode and cathode, a high-intensity corona discharge is established in an annular region between the arcuate periphery of the cathode disk and the surrounding cylindrical anode surface near the disk. Because the field is relatively narrow in the direction of gas flow, a high intensity field is achievable without prohibitive power requirements. The combination of the high gas stream velocity through the venturi and the high intensity transverse electric field through which the gas stream passes produces intense ionization and very high levels of charge on the particles and results in increased collection efficiency notwithstanding the high resistivity of the particulate as in the case of fly ash from low sulfur coal.

One of the problems which has been encountered in connection with co-axial high intensity ionizers of the type described above results from the detrimental build-up of charged particles of the cylindrical anode wall near the corona discharge plane. Deposition of high resistivity particulate matter in this region results in the phenomena of back corona and excessive sparking with a resulting deterioration in the electrical field and degradation in particle charge. Prior attempts to overcome this problem have involved "cleaning" the anode surface in the affected region to eliminate disturbances in the corona due to contaminate build-up on the outer electrode. This cleaning has been accomplished by injecting water or similar fluid onto the surface of the converging cone section of the venturi wall. The venturi is pointed in a downward direction and the water flows over the anode surface under the combined action of gravity and friction with the moving gases.

Another approach has been to utilize a venturi with a porous or perforated anode wall or a screen through which clean gas from an external source is introduced into the venturi in a direction normal to the main gas stream to form a clean gas protective barrier. The latter approach, however, has not yielded totally satisfactory results for several reasons.

First, large amounts of clean gas are required with this approach. In addition, the sharp edges and small protuberances on the surface of screens, perforated plates or porous metal ionizer walls can serve as sites for back corona initiation. Also, screens, perforated plates, wire wound cylinders with external tie bars or porous materials all have areas of low jet velocity either at the area where sheet material is joined to form a cylinder or in the wake of external structural members. Particulate matter tends to accumulate in these areas degrading the performance by promoting local back corona.

SUMMARY OF THE INVENTION

According to the present invention, the undesirable effects of charged particulate build-up on the ionizer anode wall are eliminated by injecting clean gas into the venturi through a plurality of circumferential nozzles or jets formed between a series of axially spaced conical vanes in the venturi wall. These vanes are shaped to direct jets of clean gas along the anode wall in essentially the same direction as the main gas stream. This construction generates a more effective barrier to the deposition of particulate matter on the anode than has heretofore been attainable effecting economies in the consumption of cleaning gas and improvements in ionizer performance.

The anode configuration of the present invention establishes an effective barrier film with substantially reduced quantities of clean gas being introduced into the ionizer over the systems which use screens, porous materials and such to discharge clean gas in a direction normal to the main gas stream. The orientation of the clean gas jets, being in approximately the same direction as the main gas stream, acts to entrain and aid the flow of the main gas stream, thereby reducing the pressure loss associated with the passage of the stack gases through the ionizer venturi. The back corona problems referred to above are also largely eliminated since the radii of the vane edges can be readily controlled by machining processes to eliminate the sharp edges and other discontinuities presented by screens, perforated plates, porous walls, etc. Also, the circumferential openings formed by the vanes are uninterrupted eliminating areas of low jet velocity which are prone to particulate accumulation.

DETAILED DESCRIPTION OF THE PREFERRED EMBODIMENT

Figure 1:
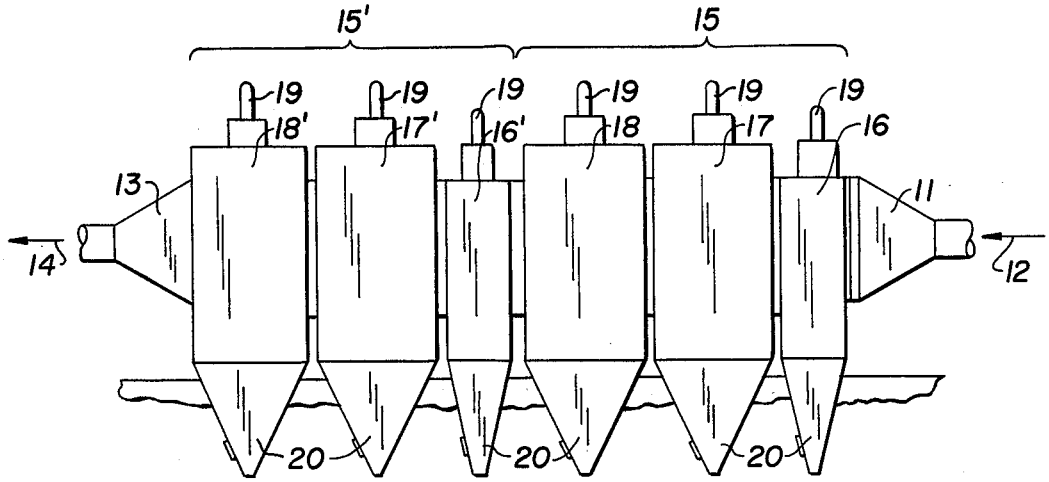
FIG. 1 is a schematic side elevational view illustrating a multi-stage electrostatic precipitator incorporating a high-intensity ionizer according to the present invention.

Turning now to the drawings, FIG. 1 shows in schematic side elevational view an electrostatic precipitator system incorporating the invention. As seen in this FIG., the precipitator system includes a gas inlet 11 into which gases to be cleaned are directed as suggested by arrow 12, a gas inlet 13 from which cleaned gases are supplied to appropriate downstream apparatus, e.g. an atmospheric discharge duct, as suggested by arrow 14, and typically a cascaded pair of ionizer-precipitator units generally designated by reference numerals 15, 15'. Each ionizer-precipitator unit 15, 15' includes an ionizer stage 16 (16') and typically a pair of conventional electrostatic precipitators 17, 18, (17', 18'). Each ionizer stage 16, 16' and precipitator stage 17, 17', 18, 18' is provided with a high voltage input connector 19 coupled to a suitable source of high voltage as described more fully below with reference to FIG. 6, and a collecting bin portion 20 for collecting particulate matter precipitated from the gas as the latter flows through units 15, 15'.

In operation, gases containing particulate matter enter the FIG. 1 apparatus via inlet 11 and pass through the first ionizer stage 16 in which the particles in the gas are electrostatically charged. The gas bearing the electrostatically charged particles next flows into successive precipitator stages 17, 18 in each of which the charged particles are deflected out of the flow path of the gas under the influence of an electrical field established across the flow path, the particles being deposited in the bin portion 20 of the precipitator stages 17, 18. The gas exiting from precipitator 18 is passed through ionizer stage 16', and precipitator stages 17', 18', to provide additional cleaning therefor, and the cleaned gases emerging from precipitator stage 18' are conducted via gas outlet 13 to appropriate downstream apparatus.

Figure 2:
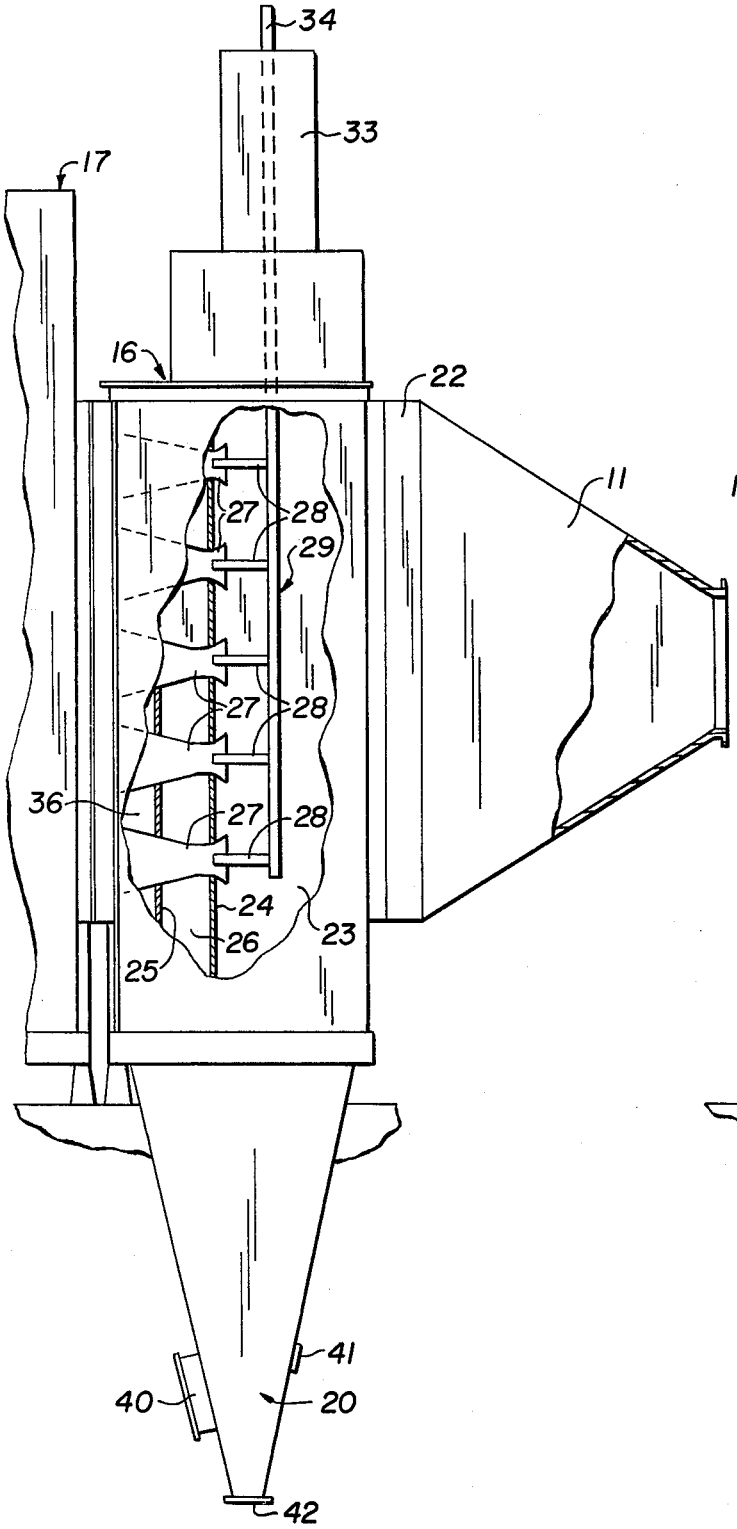
FIG. 2 is an enlarged side view of one ionizer stage of the apparatus of FIG. 1 partially broken away to show the ionizer array.
Figure 3:
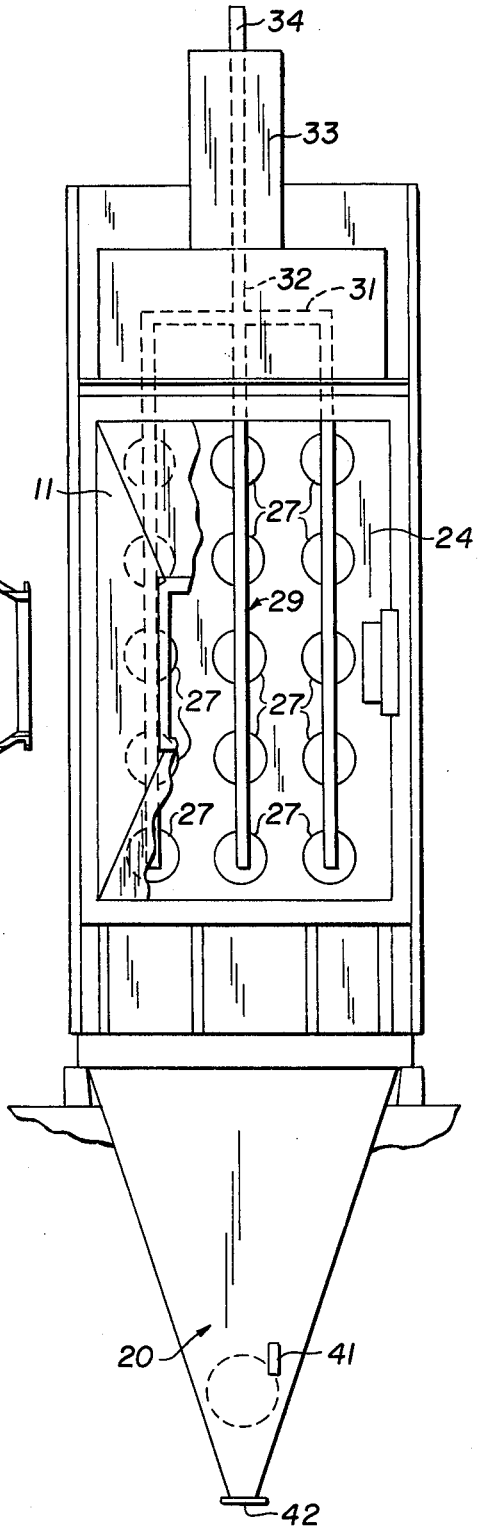
FIG. 3 is an end elevational view of the ionizer stage of FIG. 2 with the inlet partially broken away to show the ionizer array.

FIGS. 2 and 3 typically illustrate the gas inlet 11 and the first ionizer stage 16 with more detail. As seen in these FIGS., gas inlet 11 comprises a hollow conduit of trapezoidal or other suitable geometric configuration which is coupled at the downstream side to a gas distributor portion 22. Distributor portion 22 is coupled to an entry chamber 23 formed within the housing of ionizing unit 16 by the side and bottom walls thereof and a vertically arranged bulkhead 24. Bulkhead 24 and a second vertically arranged bulkhead 25 define with the side, top and bottom walls of ionizer stage 16 a pressure manifold 26 for a purpose to be described.

Positioned within ionizer stage 16 in a regular array are a plurality of venturi diffusers 27 and associated central electrode support members 28 each projecting into either end of the associated venturi 27 (shown here upstream) and substantially coaxially therewith. Each member 28 is coupled to a bus bar network generally designated by reference numeral 29 and consisting of vertically arranged parallel bus bars (three shown here) interconnected at the upper ends thereof by a common bus bar element 31, the element 31 being connected to a single bus bar element 32 extending from the interior of ionizer stage 16 to an external conventional high voltage connector shroud 33 to which a high voltage is supplied from a suitable power source (not shown) via high voltage connector 34. The downstream end or outlet of each venturi 27 is coupled to an exit chamber 36 which is in turn coupled to the inlet of electrostatic precipitator stage 17.

Storage bin 20 is provided with a removable door 40 for purposes of inspection and cleaning, and a vibrator bracket 41 for permitting the use of an optional conventional vibrator to assist in settling any particulate matter collecting in bin 20 towards the bottom edge 42 thereof. Bottom edge 42 is provided with suitable apertures (not shown) for enabling the particulate matter to be removed from the bin 20 in a conventional manner. Bins 20 of the remaining system elements 16', 17, 17', 18 and 18' are configured in a substantially identical manner.

Each venturi element 27 and associated coaxial member 28 generally comprises an electrode pair for generating a high intensity electric field across the path of gas flow through the ionizer stage 16. For this purpose, an electrode (described below) is carried by each member 28 and is coupled to a source of relatively high negative potential, via bus bar network 29 while each venturi conduit 27 is coupled via the framework of the structure to ground potential. Thus each venturi 27 serves as an anode and each member 28 serves as a cathode support.

In operation, with high voltage applied between the cathode and anode, particles suspended in any gas flowing through the ionizer stage 16 are electrostatically charged when passing through the throat of venturi 27. In order to ensure that substantially all charged particles remain suspended in the flowing gas until arriving at the downstream precipitator 17 or 18, and do not adhere to the ground potential anode surface, the novel anode configuration shown in FIGS. 4 and 5 is employed.

Figure 4:
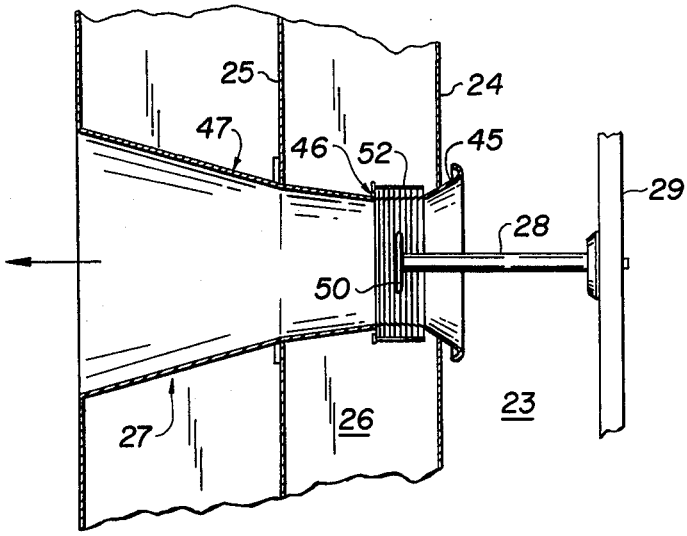
FIG. 4 is an enlarged partial sectional view of a single ionizer venturi illustrating the electrode arrangement.

With reference to FIG. 4, each venturi element 27 is formed with an inwardly tapering conical inlet section 45, a generally cylindrical central section or throat 46 and an outwardly tapering conical outlet portion 47. The cathode includes a conducting disk 50 having a curved peripheral edge which projects outwardly from the outer surface of member 28. Disc 50 is mounted substantially coaxially in the throat of venturi 27 and provides a highly constricted high-intensity electric field in the form of a corona discharge between the curved periphery of disk 50 and the surrounding anode surface 52 when a high potential is applied.

Figure 5:
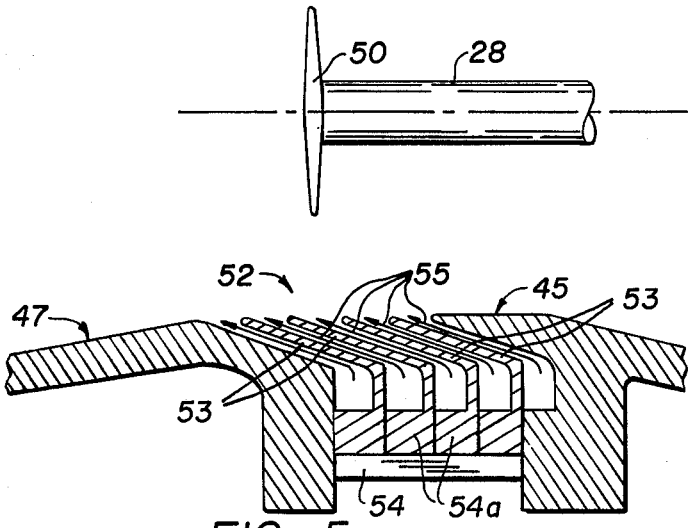
FIG. 5 is a further enlarged partial sectional view of the electrodes of FIG. 4 showing the anode vanes and cathode disk in greater detail.

As best shown in FIG. 5, anode surface 52 comprises a series of flanged conical vanes 53 structurally connected in a nested arrangement to a mounting member 54 and closely spaced along the axis of venturi 27 by spacers 54*a* to define gas passages 55 between adjacent vanes. Vanes 53 effectively form a cylindrical anode wall with a slightly sloped interrupted surface. Anode surface 52 is surrounded by plenum chamber 26 to which clean air under pressure is supplied from an external source by a pump as described below in connection with FIG. 6.

In operation, clean gas is injected into venturi throat 46 via air passages 55 which effectively form a plurality of annular nozzles and which are oriented to direct circumferential jets of clean gas along the inner anode surface of venturi 27 in essentially the same direction as the main stream of contaminated gas passing through venturi 27. The clean gas injected via passages 55 flows along the anode surface in a substantially laminar film and provides an effective fluid barrier which functions to prevent deposition and also entrain and aid the flow of the main gas stream. This has been found to significantly reduce the deposition of charged particulate matter on the anode surfaces as compared with known prior art devices. In addition, the orientation of the clean gas injection nozzles 55 reduces the pressure loss normally associated with the passage of gases through a venturi diffuser not provided with such nozzles. Also, as mentioned above, back corona problems encountered with prior art venturi ionizers can be substantially reduced by carefully contouring the edges of vanes 53.

Figure 6:
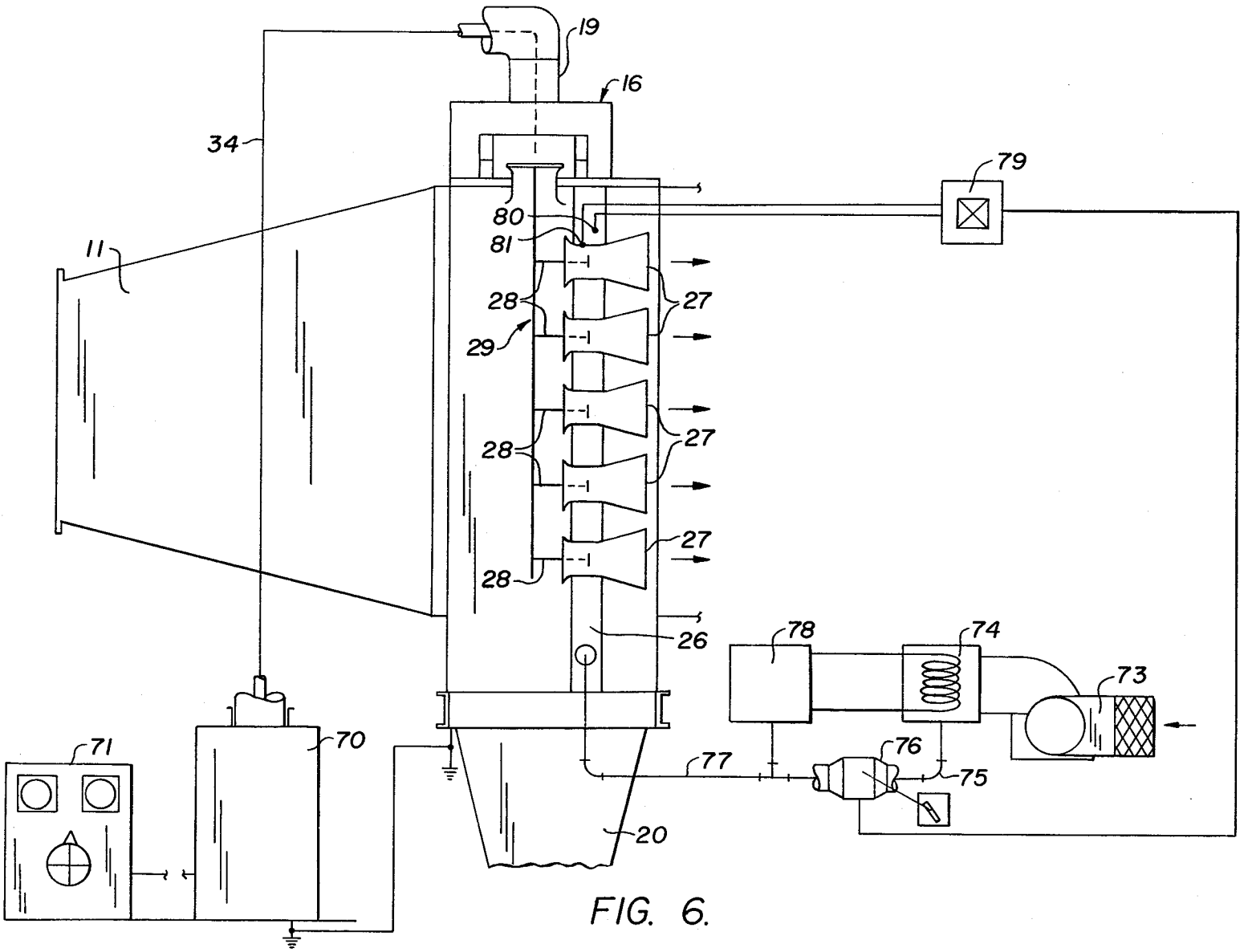
FIG. 6 is a schematic diagram showing the control system for an ionizer array with anode air supply system.

FIG. 6 schematically illustrates the electrical power connections and clean gas injection control system of ionizer stage 16. High voltage is supplied to cathode bus network 29 via high voltage cable 34 from a transformer rectifier set 70 coupled to a control unit 71, both latter elements being of conventional design. Clean gas is supplied to manifold chamber 26 from a blower 73 via a heater 74 conduit 75, a controlled damper 76 and a conduit 77. Heater 74 is connected to a temperature controller unit 78 for maintaining the temperature of the clean gas supplied to manifold chamber 26 within a desired temperature range. A differential pressure sensor 79 having a pair of pressure transducers 80, 81 provide a feedback signal to controlled damper 76 in order to provide pressure regulation for the clean air within manifold chamber 26. Elements 73–81 are all conventional units, the structure of which is well within the ordinary skill of the art.

While a preferred embodiment of the present invention has been shown and described above, it will be readily apparent to those skilled in the art that various adaptations and modifications thereof can be made without departing from the spirit and scope of the invention as defined by the following claims.

What is claimed is:

1. The method of preventing particulate deposition on the walls of a venturi diffuser which acts as the anode in a co-axial high-intensity ionizer wherein particulate-laden gases pass through a high-intensity corona discharge maintained within the throat region of said venturi comprising the steps of:

providing a source of particulate-free gas; and injecting said particulate-free gas into the throat region of said venturi interior in a substantially laminar flow along the wall thereof substantially the same direction as said particulate-laden gas stream whereby said particulate-laden gas stream is enveloped within said particulate-free gas stream.

2. The method of claim 1 further comprising the step of sensing the pressure of said particulate-free gas injected into said venturi and regulating the volume flow rate thereof in response to said pressure.

3. A high-intensity ionizer for an electrostatic precipitator comprising:

venturi means having an inlet connected to a source of particulate-laden gases and an outlet connected to said precipitator;

power means for establishing a high-intensity electric field within the throat region of said venturi and extending across the path of particulate-laden gases flowing therethrough to charge the particles therein;

injection means for introducing a stream of particulate-free gas into said venturi throat in a laminar flow along the interior walls thereof in substantially the same direction as said particulate-laden gas flow to envelope said particulate-laden gas stream and prevent deposition of said charged particles on said venturi wall in the region of said field.

4. The ionizer of claim 3 further comprising control means responsive to the pressure of said particulate-free gas stream for regulating the volume flow rate thereof.

5. The ionizer of claim 3 wherein said injection means further comprise a series of axially spaced circumferential vanes formed in the throat region of said venturi wall, the interstices between adjacent vanes defining a plurality of injection nozzles communicating at one end with said source of particulate-free gas and at the other end with the interior of said venturi, said nozzles being oriented at an oblique angle to the longitudinal axis of said venturi to direct gases issuing therefrom into said venturi throat and along the wall thereof in the direction of flow of said particulate-laden gases in a substantially laminar flow.

6. The ionizer of claim 5 wherein said venturi means further comprise a plurality of individual venturi diffuser units arranged in an array with their longitudinal axes aligned and their inlets communicating with a common gas distribution manifold connected to said source of particulate-laden gas.

7. The ionizer of claim 6 further comprising clean gas supply means including a plenum chamber surrounding at least a portion of each of said venturi units and a gas distribution manifold interconnected between said source of particulate-free gas and said plenum chamber.

8. A high-intensity ionizer for an electrostatic precipitator comprising:

at least one venturi diffuser having an inlet communicating with a source of particulate-laden gas and an outlet communicating with said precipitator;

a discharge electrode co-axially mounted within said venturi in the throat region thereof and taking the shape of a disk having an arcuate peripheral edge;

high voltage supply means connected between said venturi diffuser and electrode for establishing a high-intensity corona discharge in the annular region between the periphery of said cathode disk and the surface of said venturi wall surrounding said periphery; and a plurality of axially spaced circumferential vanes in said venturi wall, spaces between adjacent vanes defining a plurality of injection nozzles having discharge orifices communicating with said venturi throat, said nozzles being oriented at an oblique angle to the longitudinal axis of said venturi to direct gases issuing therefrom into said venturi throat and along the wall thereof towards the venturi outlet in a substantial laminar flow.

9. In a co-axial high-intensity ionizer for an electrostatic precipitator wherein said ionizer includes at least one venturi diffuser through which particulate-laden gases flow between a source and a precipitator, the improvement comprising:

a source of particulate-free gas;

a chamber surrounding at least a portion of each of said venturis;

gas distribution means interconnecting said source of particulate-free gas and said chamber; and at least two axially spaced circumferential vanes formed in the throat region of said venturi wall with the spaces between adjacent vanes interconnecting said chamber and the interior of said venturi and defining gas flow channels oriented obliquely to the longitudinal axis of said venturi for injecting gas introduced into said chamber under pressure into said venturi throat in a laminar flow along the interior wall thereof whereby said particulate-laden gas stream is enveloped by said particulate-free gas stream to reduce particulate deposition on said venturi wall.

10. A venturi diffuser for use in connection with a co-axial electrode high-intensity gas ionizer wherein at least a portion of the interior wall of said venturi serves as the ionizer anode and an electrode centrally mounted within the throat region of said venturi serves as the ionizer cathode, said venturi comprising:

an inwardly tapering conical inlet section communicating with a source of particulate-laden gas;

an outwardly tapering conical outlet section; and a central throat section intermediate said inlet and outlet and being formed along at least a portion of the surface thereof with a plurality of axially spaced circumferential vanes, the spaces between adjacent vanes defining injection orifices communicating at one end with a source of particulate-free gas and at the other end with the interior of said venturi and being oriented to direct gas introduced at said one end under pressure into said venturi interior in a substantially laminar flow along the interior wall thereof in substantially the same direction as said particulate-laden gases.

* * * * *